US010580248B2

(12) United States Patent
Sugahara et al.

(10) Patent No.: US 10,580,248 B2
(45) Date of Patent: Mar. 3, 2020

(54) COIN HANDLING APPARATUS

(71) Applicant: GLORY LTD., Hyogo (JP)

(72) Inventors: Kazuma Sugahara, Hyogo (JP); Masato Takeuchi, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 15/988,203

(22) Filed: May 24, 2018

(65) Prior Publication Data

US 2018/0342127 A1 Nov. 29, 2018

(30) Foreign Application Priority Data

May 24, 2017 (JP) ..... 2017-103084

(51) Int. Cl.

| | |
|---|---|
| ***G07F 1/04*** | (2006.01) |
| ***G07D 9/00*** | (2006.01) |
| ***G07D 1/00*** | (2006.01) |
| ***G07D 1/02*** | (2006.01) |
| ***G07D 3/14*** | (2006.01) |

(52) U.S. Cl.

CPC ..... *G07F 1/041* (2013.01); *G07D 1/00* (2013.01); *G07D 1/02* (2013.01); *G07D 3/14* (2013.01); *G07D 9/008* (2013.01); *G07D 2201/00* (2013.01)

(58) Field of Classification Search

CPC . G07F 1/041; G07D 1/00; G07D 1/02; G07D 2201/00; G07D 9/008; G07D 3/14

See application file for complete search history.

(56) References Cited

U.S. PATENT DOCUMENTS

| | | | | |
|---|---|---|---|---|
| 5,016,397 | A * | 5/1991 | Higginbotham | B24B 19/223 414/412 |
| 5,088,587 | A * | 2/1992 | Goodrich | G07F 1/041 194/345 |
| 6,206,167 | B1 * | 3/2001 | Taylor | G07F 1/04 193/DIG. 1 |
| 9,135,765 | B2 * | 9/2015 | Sackfield | G07D 5/08 |
| 2002/0189920 | A1 * | 12/2002 | Molbak | G07D 1/04 194/347 |
| 2006/0054457 | A1 | 3/2006 | Long et al. | |

FOREIGN PATENT DOCUMENTS

| | | |
|---|---|---|
| DE | 102007057427 A1 | 6/2009 |
| JP | 2011-014000 A | 1/2011 |

OTHER PUBLICATIONS

Extended European Search Report for EP18174090.3 dated Oct. 24, 2018, 7 pages.

* cited by examiner

*Primary Examiner* — Mark J Beauchaine

(74) *Attorney, Agent, or Firm* — Brundidge & Stanger, P.C.

(57) ABSTRACT

There is provided a coin handling apparatus capable of reducing the occurrence of failure caused by a foreign material. A coin handling apparatus includes a coin inlet unit into which coins are put, a coin receiving unit that receives the coins put into the coin inlet unit, a coin discharge unit to which the coins are discharged, and a foreign material discharge chute which is connected to the coin inlet unit and the coin discharge unit and along which a foreign material put into the coin inlet unit is discharged to the coin discharge unit.

15 Claims, 9 Drawing Sheets

COIN HANDLING APPARATUS

CROSS REFERENCE TO RELATED APPLICATIONS

The disclosure of Japanese Patent Application No. 2017-103084 filed on May 24, 2017 including the specification, drawings and abstract is incorporated herein by reference in its entirety.

TECHNICAL FIELD

The present invention relates to a coin handling apparatus.

BACKGROUND ART

Conventionally, as a coin handling apparatus that handles coins, there are known coin handling apparatuses, for example, a register change apparatus, a money changer, and a rolled coin handling apparatus. The coin handling apparatuses each need to discharge a foreign material accidentally put along with coins into the apparatus out of the apparatus.

In PTL 1, a foreign material put along with deposit coins into a transaction port travels along a chute and enters a feeding unit that feeds the coins onto a transport unit. The foreign material having entered the feeding unit is discharged to a coin return port provided in the front surface of the apparatus.

CITATION LIST

Patent Literature

PTL 1
Japanese Patent Application Laid-Open No. 2011-14000

SUMMARY OF INVENTION

Technical Problem

In PTL 1, however, the foreign material enters the feeding unit and therefore possibly causes failure in feeding the coins.

An object of the present invention is to provide a technology for reducing the occurrence of failure caused by a foreign material.

Solution to Problem

A coin handling apparatus according to the present invention includes a coin inlet unit into which coins are put; a coin receiving unit that receives the coins put into the coin inlet unit; a coin discharge unit to which the coins are discharged; and a foreign material discharge chute which is connected to the coin inlet unit and the coin discharge unit and along which a foreign material is discharged to the coin discharge unit, the foreign material having been put into the coin inlet unit.

Advantageous Effects of Invention

The present invention allows reduction in the occurrence of failure caused by a foreign material.

DESCRIPTION OF EMBODIMENTS

Embodiments of the present invention will be described below with reference to the accompanying drawings.

Figure 1:
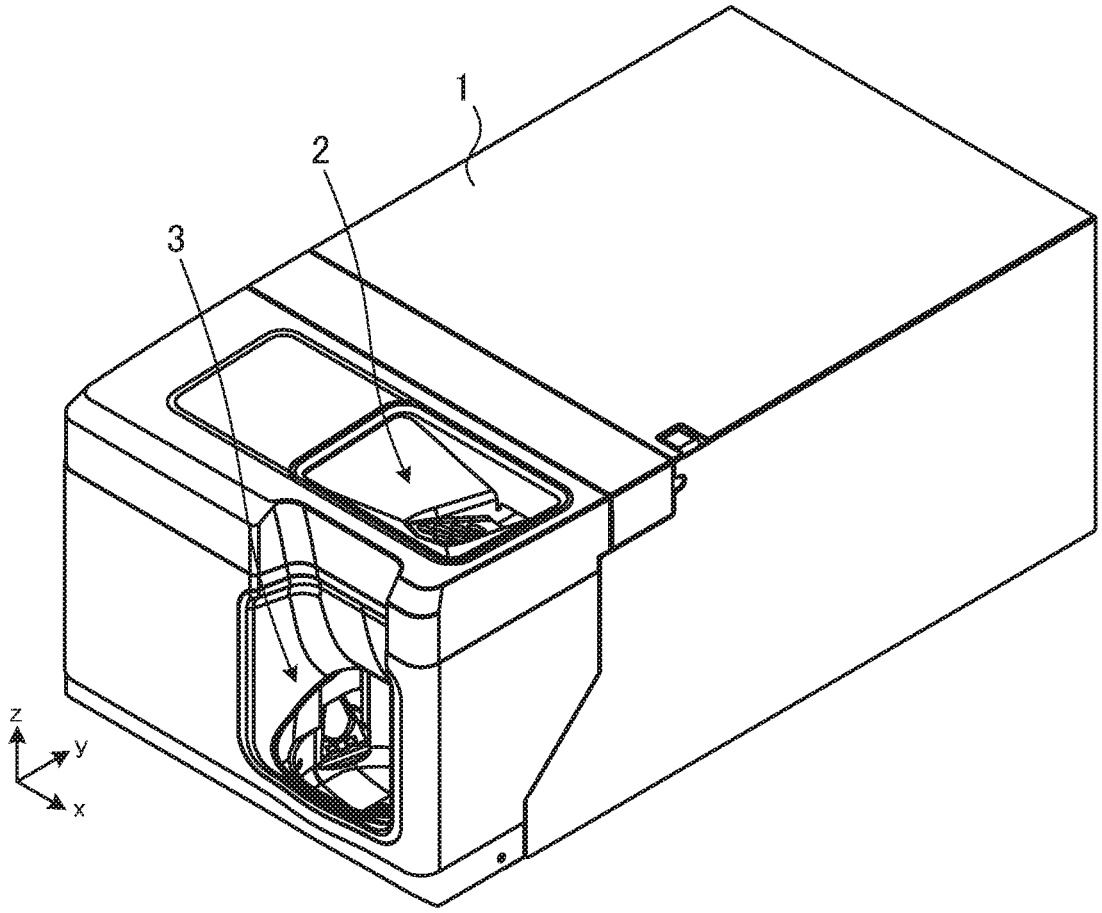
FIG. 1 is a perspective view showing an example of a coin handling apparatus according to an embodiment of the present invention.

FIG. 1 is a perspective view showing an example of a coin handling apparatus 1 according to the present embodiment. The coin handling apparatus 1 includes an inlet (coin inlet unit) 2 and an outlet (coin discharge unit) 3, as shown in FIG. 1. The coin handling apparatus 1, for example, stores coins paid at a register or feeds stored coins as changes. In the following description, a three-axis coordinate system, such as that shown in FIG. 1, is set in relation to the coin handling apparatus 1.

The inlet 2 is provided in a front upper surface of the apparatus. The inlet 2 is disposed in a position shifted from the center in the x-axis direction when viewed from the side facing the front surface of the apparatus. For example, in the coin handling apparatus 1 shown in FIG. 1, the inlet 2 is provided in a position shifted rightward from the center in the x-axis direction when viewed from the side facing the front surface of the apparatus.

Coins to be deposited in the coin handling apparatus 1 are put into the inlet 2. The coins put into the inlet 2 are stored in the coin handling apparatus 1.

The outlet 3 is provided in the front surface of the apparatus and below the inlet 2. Coins stored in the coin handling apparatus 1 are withdrawn to the outlet 3. Coins rejected at the time of deposit are withdrawn to the outlet 3.

Figure 2:
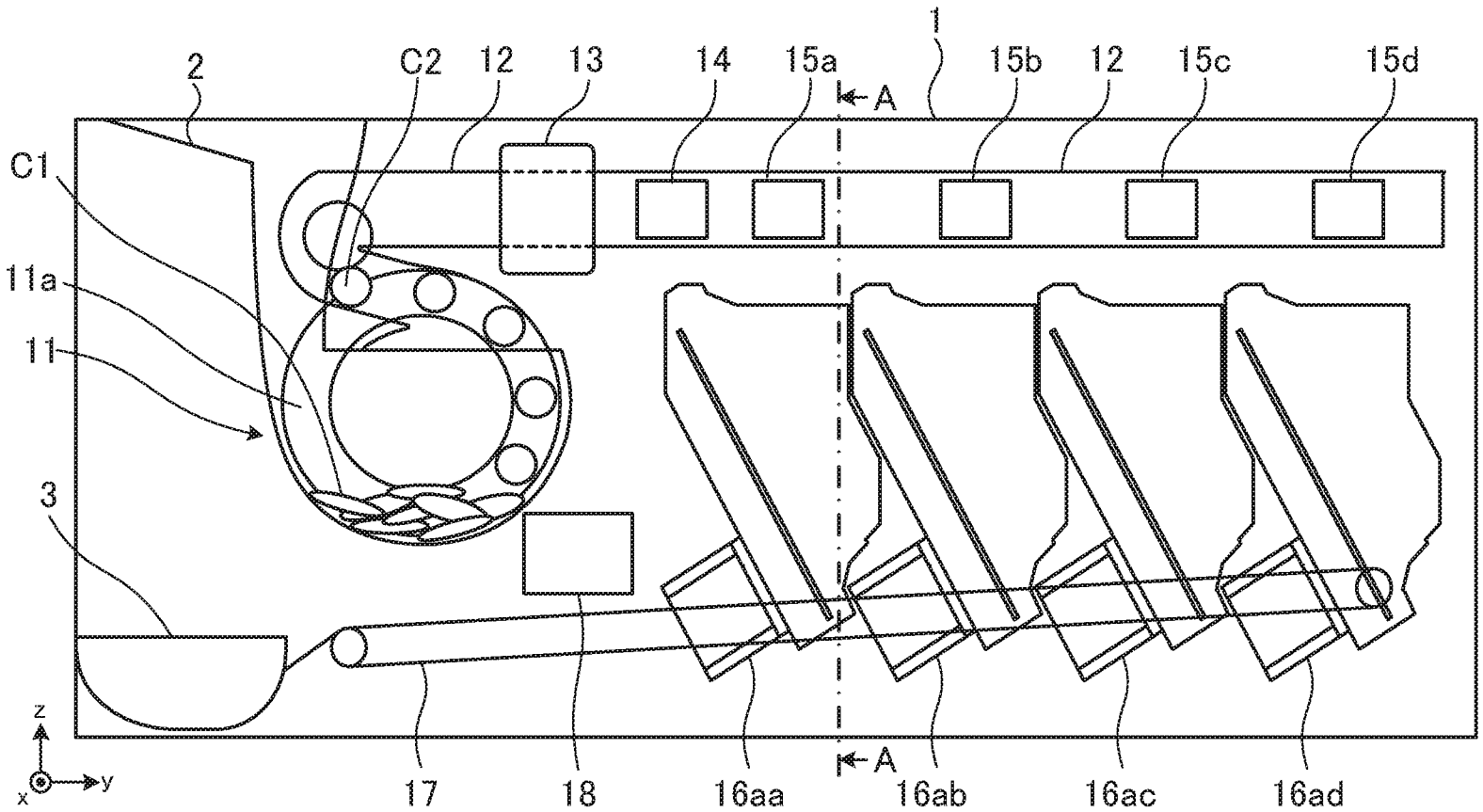
FIG. 2 is a side cross-sectional view of the coin handling apparatus.

FIG. 2 is a side cross-sectional view of the coin handling apparatus 1. The coin handling apparatus 1 shown in FIG. 2 is a simplified version of the coin handling apparatus 1 shown in FIG. 1 in terms of the shape and other factors. In FIG. 2, the same portions as those in FIG. 1 have the same reference characters.

The coin handling apparatus 1 includes a coin receiving unit that accepts the coins having been put into a deposit unit. The coin receiving unit may, for example, be a storing/feeding unit that stores accepted coins and feeds the coins one by one as required. The coin handling apparatus 1 includes a storing/feeding unit 11, a transport unit 12, an identifying unit 13, coin diverters 14 and 15*a* to 15*d*, storing/feeding units 16*aa* to 16*ad*, a withdrawal transport unit 17, and a collection box 18, as shown in FIG. 2.

Coins put into the inlet 2 travel along a chute and drop into the storing/feeding unit 11. The storing/feeding unit 11 temporarily accumulates the coins put into the inlet 2. Coins C1 shown in FIG. 2 represent the coins temporarily accumulated in a hopper of the storing/feeding unit 11.

The storing/feeding unit 11 includes a feeding disk. The feeding disk may be a disk having the function of feeding coins while rotating, for example, an inclining disk 11*a* (see FIG. 11, for example), which rotates around an axis inclining with respect to the vertical direction. The inclining disk 11*a* has coin catching protrusions (not shown) on the front surface thereof. The storing/feeding unit 11 rotates the inclining disk 11*a* (counterclockwise in FIG. 2, for example) to allow the protrusions on the front surface thereof to catch the temporarily accumulated coins C1 and pick them up. The storing/feeding unit 11 then feeds the coins C1 picked up by the inclining disk 11*a* onto the transport unit 12. A coin C2 shown in FIG. 2 represents a coin being fed by the inclining disk 11*a* onto the transport unit 12.

A foreign material enters the hopper of the storing/feeding unit 11 in some cases, as will be described later. Foreign materials therefore accumulate in the hopper of the storing/feeding unit 11 in some cases. To solve the problem described above, the hopper of the storing/feeding unit 11 is provided with a discharge port (not shown in FIG. 2) through which the foreign materials are discharged. A discharge chute (not shown) along which the foreign materials are discharged is connected to the discharge port, and the discharge chute is connected to the outlet 3. That is, the foreign materials having accumulated in the hopper are discharged to the outlet 3.

The transport unit 12 is provided immediately below the upper surface of the coin handling apparatus 1. The transport unit 12 is provided roughly at the center in the x-axis direction when viewed from the side facing the front surface or the rear surface of the apparatus (see FIG. 3 or 4, for example).

The transport unit 12 extends from the front side toward the rear side of the apparatus. The transport unit 12 transports the coins fed from the storing/feeding unit 11 from the front side toward the rear side of the apparatus. The transport unit 12 can, for example, be based on a typical technology for transporting coins on a transport belt.

The identifying unit 13 is provided on the downstream side of the storing/feeding unit 11 but on the upstream side of the coin diverters 14 and 15*a* to 15*d* and on the transport unit 12. The identifying unit 13 identifies the coins fed from the storing/feeding unit 11. For example, the identifying unit 13 includes a variety of sensors, such as a magnetism sensor, and identifies the denomination of a coin transported by the transport unit 12 to be, for example, an accepted coin, a rejected coin, or a collected coin (counterfeit coin, for example).

The coin diverter 14 diverts the coins transported by the transport unit 12 in three directions. For example, the coin diverter 14 diverts the coins transported by the transport unit 12 in a downstream transport direction (direction in which coins are directly transported by transport unit 12 (+y-axis direction)), the direction leading to the withdrawal transport unit 17, and the direction leading to the collection box 18.

The coin diverter 14 diverts the coins transported by the transport unit 12 in the three directions in accordance with the result of the identification performed by the identifying unit 13. For example, the coin diverter 14 diverts a coin identified by the identifying unit 13 to be a rejected coin in the direction leading to the withdrawal transport unit 17. A rejected coin includes a coin of a denomination that cannot be accepted as a deposited coin, a coin of a denomination that has not been successfully identified, and a counterfeit coin or a coin suspected thereof. The coin diverter 14 diverts coins having been identified by the identifying unit 13 to be collected coins in the direction leading to the collection box 18. A collected coin includes a coin of a denomination accepted as a deposited coin but not used as a withdrawn coin. Among rejected coins, counterfeit coins or coins suspected thereof may be stored in the collection box 18. The coin diverter 14 diverts coins which have been identified by the identifying unit 13 not to be rejected coins or collected coins and the denomination of which has been determined in the downstream transport direction.

The coin diverters 15*a* to 15*d* each divert the coins transported by the transport unit 12 in three directions. For example, the coin diverters 15*a* to 15*d* each divert the coins transported by the transport unit 12 in the downstream transport direction (+y-axis direction), in the direction leading to the storing/feeding units 16*aa* to 16*ad*, and the direction leading to four storing/feeding units 16*ba* to 16*bd* (see FIG. 3 or 4, for example) so provided as to face the storing/feeding units 16*aa* to 16*ad* via the transport unit 12.

The coin diverters 15*a* to 15*d* each divert the coins transported by the transport unit 12 in the three directions in accordance with the result of the identification performed by the identifying unit 13. For example, the coin diverter 15*a* diverts a coin having been identified by the identifying unit 13 to be a coin of a first denomination in the direction leading to the storing/feeding unit 16*aa* (see arrow A2 in FIG. 3, for example). The coin diverter 15*a* diverts a coin having been identified by the identifying unit 13 to be a coin of a second denomination in the direction leading to the storing/feeding unit so provided as to face the storing/feeding unit 16*aa* via the transport unit 12 (see arrow A3 in FIG. 3, for example). The coin diverter 15*a* diverts a coin having been identified by the identifying unit 13 to be a coin of a denomination other than the first and second denominations in the downstream transport direction (+y-axis direction in FIG. 3, for example).

The coin diverter 15*b* diverts a coin having been identified by the identifying unit 13 to be a coin of a third denomination in the direction leading to the storing/feeding unit 16*ab*. The coin diverter 15*b* diverts a coin having been identified by the identifying unit 13 to be a coin of a fourth denomination in the direction leading to the storing/feeding unit so provided as to face the storing/feeding unit 16*ab* via the transport unit 12. The coin diverter 15*b* diverts a coin having been identified by the identifying unit 13 to be a coin of a denomination other than the first to fourth denominations in the downstream transport direction.

The coin diverter 15*c* also diverts the coins transported by the transport unit 12 in three directions, as do the coin diverters 15*a* and 15*b*. The coin diverter 15*d* diverts the coins in two directions because there is no apparatus on the downstream side of the transport unit 12. For example, the coin diverter 15*d* diverts the coins transported by the transport unit 12 in the following two directions; the direction leading to the storing/feeding unit 16*ad*; and the direction leading to the storing/feeding unit so provided as to face the storing/feeding unit 16*ad* via the transport unit 12.

The storing/feeding units 16*aa* to 16*ad* each store the coins transported by the transport unit 12 in a hopper. The coins transported by the transport unit 12 are diverted (sorted) by the coin diverters 15*a* to 15*d* in accordance with the result of the identification performed by the identifying unit 13, as described above. The storing/feeding units 16*aa* to 16*ad* can each thus store coins on a denomination basis.

The coin handling apparatus 1 includes the four storing/feeding units 16*ba* to 16*bd* that face the storing/feeding units 16*aa* to 16*ad* via the transport unit 12, as will be described later. The coin handling apparatus 1 can therefore store coins of eight denominations at the maximum.

The storing/feeding units 16*aa* to 16*ad* (including storing/feeding units so provided as to face storing/feeding units 16*aa* to 16*ad* via transport unit 12) each feed stored coins onto the withdrawal transport unit 17. The storing/feeding units 16*aa* to 16*ad* each have an inclining disk having coin catching protrusions provided on the surface thereof. The storing/feeding units 16*aa* to 16*ad* each rotate the inclining disk to allow the protrusions on the front surface thereof to catch coins and pick the coins up. The storing/feeding units 16*aa* to 16*ad* each feed the coins picked up by the inclining disk via a feeding exit and drop the coins onto the withdrawal transport unit 17 (see arrow A1 in FIG. 3, for example).

The withdrawal transport unit 17 is provided below the transport unit 12 and above the bottom surface of the coin handling apparatus 1. The withdrawal transport unit 17 extends from the front side toward the rear side of the apparatus. Rejected coins diverted by the coin diverter 14 are dropped onto the withdrawal transport unit 17. Coins fed from the storing/feeding units 16*aa* to 16*ad* (including storing/feeding units so provided as to face storing/feeding units 16*aa* to 16*ad* via transport unit 12) are also dropped onto the withdrawal transport unit 17. The withdrawal transport unit 17 transports the rejected coins diverted by the coin diverter 14 and the coins fed from the storing/feeding units 16*aa* to 16*ad* to the outlet 3. The withdrawal transport unit 17 transports the dropped coins to the outlet 3, for example, with the aid of a transport belt.

The collection box 18 stores collected coins diverted by the coin diverter 14. The collection box 18 is a box having no feeding function but dedicated to storage.

The coin handling apparatus 1 includes a foreign material discharge chute (not shown in FIG. 2) that links the inlet 2 to the outlet 3. The foreign material discharge chute causes a foreign material put along with coins into the inlet 2 to be discharged to the outlet 3.

Figure 3:
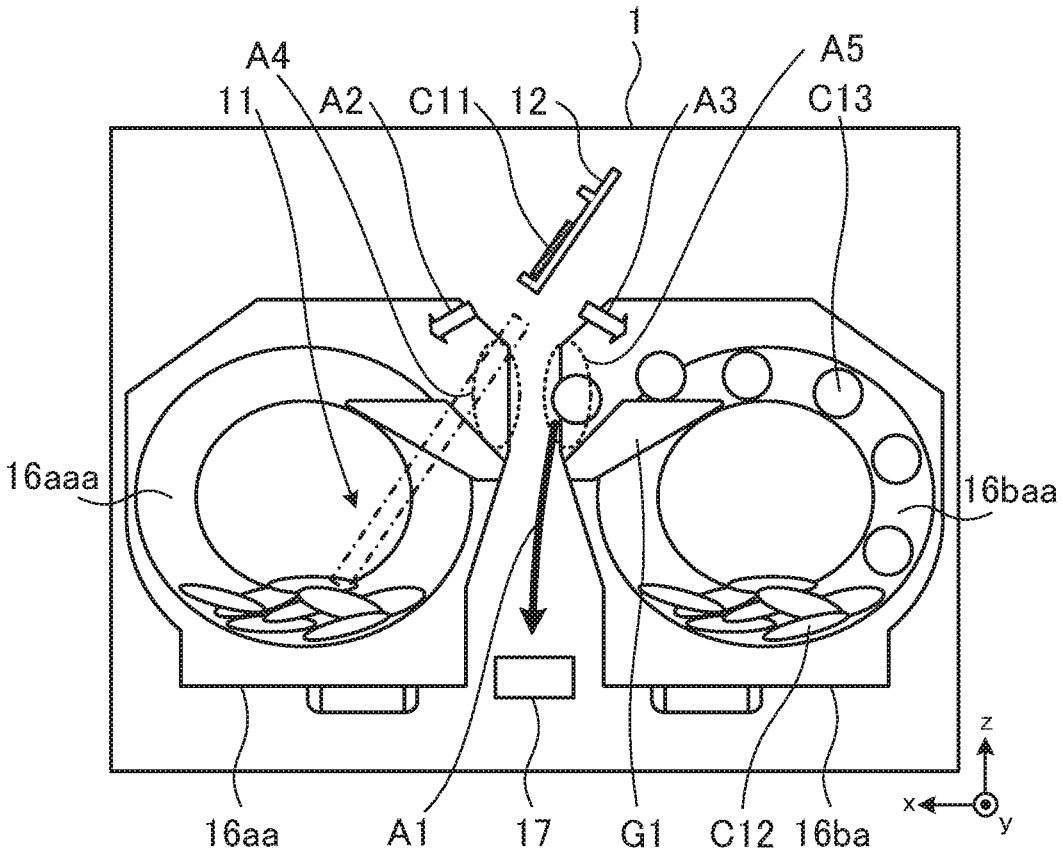
FIG. 3 is a cross-sectional view taken along the line A-A indicated by the arrows in FIG. 2.

FIG. 3 is a cross-sectional view taken along the line A-A in FIG. 2. In FIG. 3, the same portions as those in FIG. 2 have the same reference characters. In FIG. 3, part of the components shown in FIG. 2 is omitted.

The coin handling apparatus 1 includes a storing/feeding unit 16*ba*, as shown in FIG. 3. The storing/feeding unit 16*ba* is so provided as to face the storing/feeding unit 16*aa* via the transport unit 12.

The chain line shown in FIG. 3 represents the inclining disk 11*a* of the storing/feeding unit 11. The inclining disk 11*a* is so disposed as to incline with respect to the vertical direction. FIG. 3 also shows a coin C11 transported by the transport unit 12. The transport path of the transport unit 12, which transports the coin C11, inclines with respect to the vertical direction, as shown in FIG. 3.

The direction in which the coin C11 is transported by the transport unit 12 is diverted by the coin diverter 15*a* (not shown in FIG. 3) in accordance with the result of the identification performed by the identifying unit 13, and the coin C11 transported by the transport unit 12 is stored in the storing/feeding unit 16*aa* or 16*ba*.

For example, in a case where the coin C11 is of the denomination to be stored in the storing/feeding unit 16*aa*, the transport direction is diverted (changed) as indicated by the arrow A2. The coin C11 diverted in the direction indicated by the arrow A2 is stored in the storing/feeding unit 16*aa*. In a case where the coin C11 is of the denomination to be stored in the storing/feeding unit 16*ba*, the transport direction is diverted as indicated by the arrow A3. The coin C11 diverted in the direction indicated by the arrow A3 is stored in the storing/feeding unit 16*ba*.

The storing/feeding unit 16*aa* includes an inclining disk 16*aaa*. The inclining disk 16*aaa* is so disposed as to incline with respect to the vertical direction. The inclining disk 16*aaa* rotates clockwise in FIG. 3 to pick up coins stored in the hopper and feeds the coins to the feeding exit.

The storing/feeding unit 16*ba* includes an inclining disk 16*baa*. The inclining disk 16*baa* is so disposed as to incline with respect to the vertical direction. The inclining disk 16*baa* rotates counterclockwise in FIG. 3 to pick up coins stored in the hopper and feeds the coins to the feeding exit.

A coin C12 shown in FIG. 3 represents a coin stored in the hopper of the storing/feeding unit 16*ba*. A coin C13 represents a coin to be fed from the storing/feeding unit 16*ba*.

The coin C13 is caught by a protrusion (not shown) on the inclining disk 16*baa*, which is provided in the storing/feeding unit 16*ba*, and picked up. The coin C13 then mounts on the upper end of a plate-shaped guide G1, therefore separates from the inclining disk, and drops onto the withdrawal transport unit 17, as indicated by the arrow A1 in FIG. 3. The dotted-line frames indicated by the arrows A4 and A5 in FIG. 3 represent the feeding exits via which coins are fed.

Figure 4:
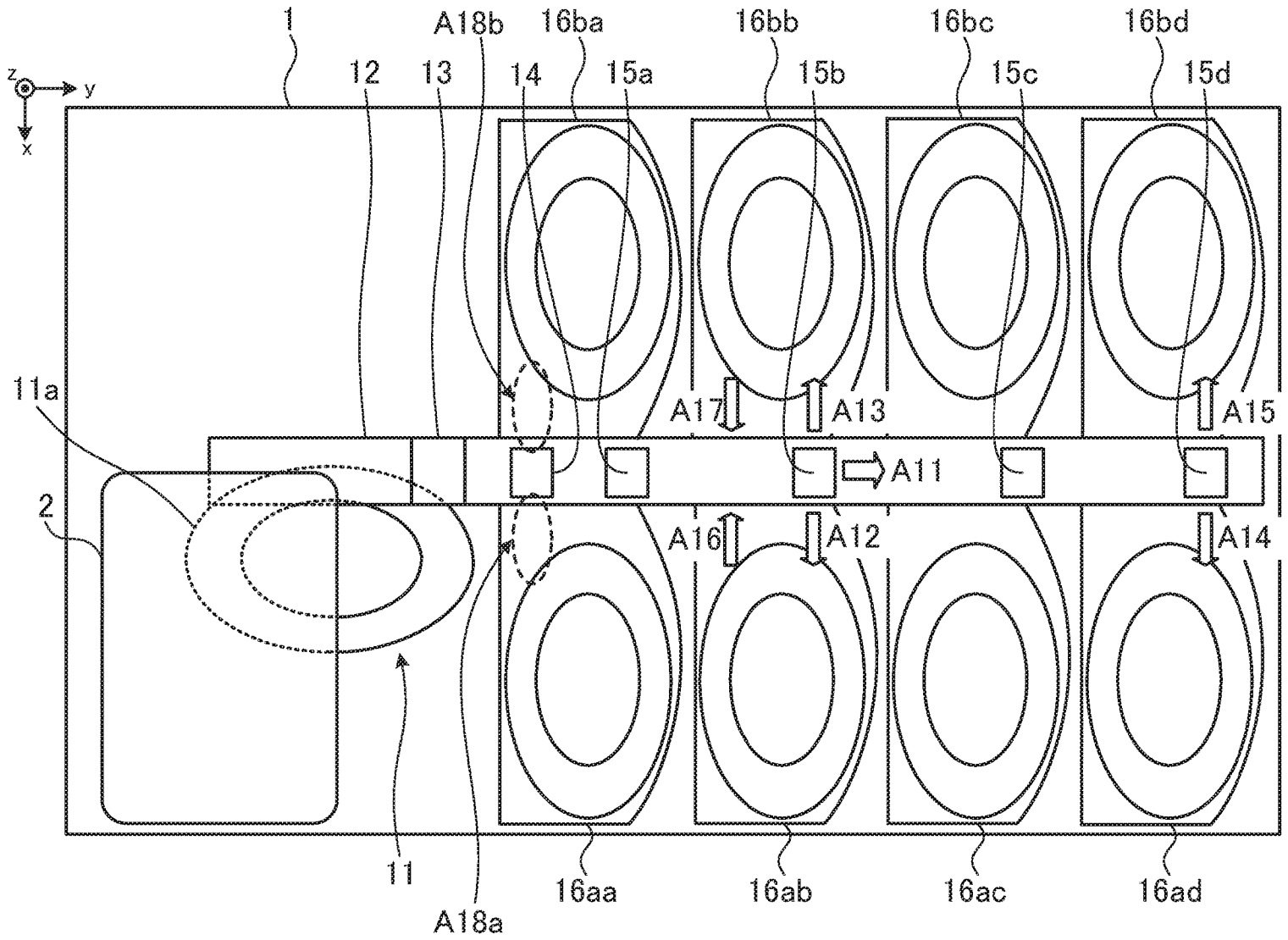
FIG. 4 shows the coin handling apparatus in FIG. 2 viewed in a +z-axis direction.

FIG. 4 shows the coin handling apparatus 1 in FIG. 2 viewed in the +z-axis direction. In FIG. 4, the same portions as those in FIGS. 2 and 3 have the same reference characters.

The coin handling apparatus 1 includes storing/feeding units 16*bb* to 16*bd*, as shown in FIG. 4. The storing/feeding units 16*bb* to 16*bd* are so provided as to face the storing/feeding units 16*ab* to 16*ad* via the transport unit 12. That is, the row of the storing/feeding units 16*aa* to 16*ad* and the row of the storing/feeding units 16*ba* to 16*bd* are disposed on the right and left sides of the transport unit 12 (or withdrawal transport unit 17) in the plan view.

The coin diverters 14 and 15*a* to 15*c* divert the coins transported by the transport unit 12 in the three directions, as described above. For example, the coin diverter 15*b* diverts the coins transported by the transport unit 12 in the downstream transport direction, as indicated by the arrow A11. The coin diverter 15*b* diverts the coins transported by the transport unit 12 in the direction toward the storing/feeding unit 16*ab*, as indicated by the arrow A12. The coin diverter 15*b* diverts the coins transported by the transport unit 12 in the direction toward the storing/feeding unit 16*bb*, as indicated by the arrow A13. The coin diverter 15*d* diverts the coins in the two directions, as indicated by the arrows A14 and A15.

At the time of withdrawal, the storing/feeding units 16*aa* to 16*ad* and 16*ba* to 16*bd* feed coins stored therein. For example, the storing/feeding units 16*ab* and 16*bb* feed coins stored therein in the positions indicated by the arrows A16 and A17 (see positions of feeding exits indicated by arrows A4 and A5 in FIG. 3). The fed coins are dropped onto the withdrawal transport unit 17, as indicated by the arrow A1 in FIG. 3, and withdrawn via the outlet 3.

The dotted-line frames indicated by the arrows A18*a* and A18*b* in FIG. 4 represent the positions of the feeding exits via which coins in the storing/feeding units 16*aa* and 16*ba* are fed. The feeding exits fed in the form of the dotted-line frames indicated by the arrows A18*a* and A18*b* correspond to the feeding exits indicated by the arrows A4 and A5 in FIG. 3. The storing/feeding units 16*ab* to 16*ad* and 16*bb* to 16*bd* also have feeding exits in positions similar to the positions of the feeding exits of the storing/feeding units 16*aa* and 16*ba*. The storing/feeding units 16*ab* to 16*ad* and 16*bb* to 16*bd* are so disposed that the feeding exits thereof face each other via the transport unit 12.

The inclining disk of each of the storing/feeding units 16*ab* to 16*ad* shown in FIG. 4 rotates in the same direction in which the inclining disk 16*aaa* of the storing/feeding unit 16*aa* described with reference to FIG. 3 rotates. The inclining disk of each of the storing/feeding units 16*bb* to 16*bd* shown in FIG. 4 rotates in the same direction in which the inclining disk of the storing/feeding unit 16*ba* described with reference to FIG. 3 rotates. That is, the inclining disks of the right-row storing/feeding units 16*aa* to 16*ad* and the inclining disks of the left-row storing/feeding units 16*ba* to 16*bd* rotate in opposite directions.

The storing/feeding units 16*aa* to 16*ad* and the storing/feeding units 16*ba* to 16*bd* are configured differently from each other. For example, the storing/feeding units 16*aa* to 16*ad* and the storing/feeding units 16*ba* to 16*bd* are bilaterally symmetric with respect to the transport unit 12 in terms of the shape of the guides, the shape of the hoppers, the shape of the protrusions on the inclining disks, and other factors (see FIG. 3, for example).

Specific actions of the coin handling apparatus 1 will be described with reference to FIG. 2. A deposit action will first be described.

Coins put into the inlet 2 are accumulated in the hopper of the storing/feeding unit 11. The coins accumulated in the hopper of the storing/feeding unit 11 are picked up by the inclining disk 11*a* and fed onto the transport unit 12.

The coins fed onto the transport unit 12 are identified by the identifying unit 13. In a case where the identified coins are not rejected coins or collected coins, the direction in which the coins are transported is diverted by the coin diverters 15*a* to 15*d*, and the coins are stored in one of the storing/feeding units 16*aa* to 16*ad* and 16*ba* to 16*bd*.

In a case where the identified coins are rejected coins, the direction in which the rejected coins are transported is diverted by the coin diverter 14, and the rejected coins are dropped onto the withdrawal transport unit 17. The rejected coins dropped onto the withdrawal transport unit 17 are transported to an outlet coin discharge unit 3.

In a case where the identified coins are collected coins, the direction in which the collected coins are transported is diverted by the coin diverter 14, and the collected coins are dropped into the collection box 18 and stored therein.

A withdrawal action will next be described.

The coins stored in the storing/feeding units 16*aa* to 16*ad* and 16*ba* to 16*bd* are picked up by the inclining disks provided in the storing/feeding units 16*aa* to 16*ad* and 16*ba* to 16*bd*. The picked-up coins are led along the guides to the feeding exits (see FIG. 3) and dropped onto the withdrawal transport unit 17. The coins dropped onto the withdrawal transport unit 17 are transported to the outlet 3.

The foreign material discharge chute will be described.

Figure 5:
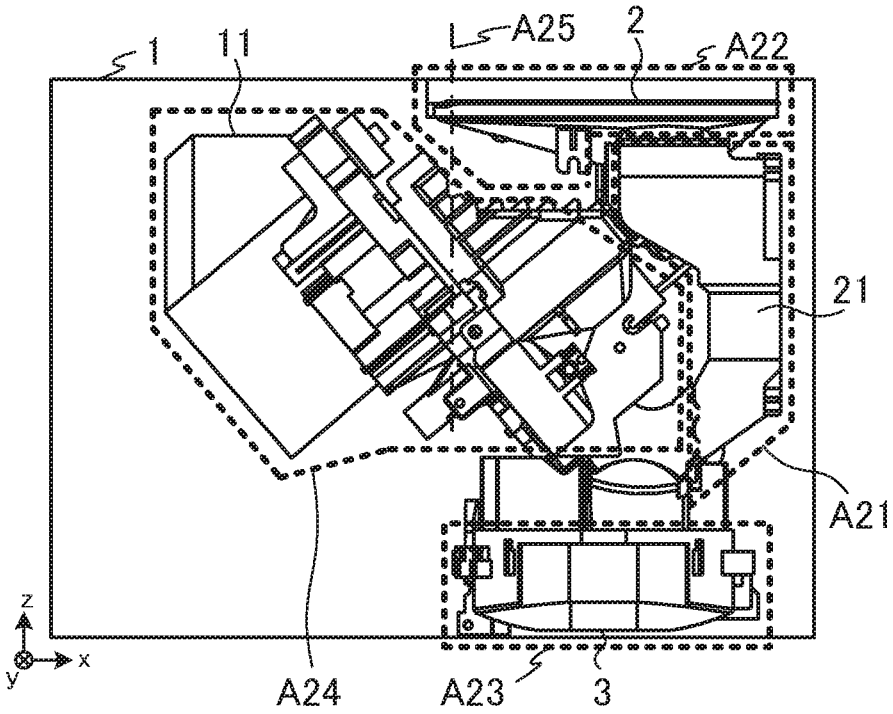
FIG. 5 is a front view of the coin handling apparatus.

FIG. 5 is a front view of the coin handling apparatus 1. In FIG. 5, the same portions as those in FIGS. 2 to 4 have the same reference characters. FIG. 5 shows the exterior shape and other factors of the coin handling apparatus 1 in more detail than FIGS. 2 to 4.

The coin handling apparatus 1 includes a foreign material discharge chute 21, as shown in FIG. 5. The portion indicated by the dotted-line frame A21 in FIG. 5 is the foreign material discharge chute 21.

FIG. 5 shows the inlet 2 described with reference to FIG. 2 and other figures. The portion indicated by the dotted-line frame A22 in FIG. 5 is the inlet 2. FIG. 5 further shows the outlet 3 described with reference to FIG. 2 and other figures. The portion indicated by the dotted-line frame A23 in FIG. 5 is the outlet 3. FIG. 5 further shows the storing/feeding unit 11 described with reference to FIG. 2 and other figures. The portion indicated by the dotted-line frame A24 in FIG. 5 is the storing/feeding unit 11.

The storing/feeding unit 11 is disposed roughly at the center in the x-axis direction when viewed from the side facing the front surface of the apparatus. For example, the center of the storing/feeding unit 11 in the rightward/leftward direction (chain line indicated by arrow A25) coincides with the center in the x-axis direction.

The inlet 2 is so disposed as to be shifted from the center of the storing/feeding unit 11 in the rightward/leftward direction (horizontal direction) toward the side where the hopper is present when viewed from the side facing the front surface of the apparatus. Since the hopper of the storing/feeding unit 11 is located on the right of the chain line A25 shown in FIG. 5 (see FIG. 11, for example), the inlet 2 is disposed on the right of the center of the storing/feeding unit 11 when viewed from the side facing the front surface of the apparatus.

The outlet 3 is provided below the inlet 2, as described above. That is, the outlet 3 is also disposed on the right of the center of the storing/feeding unit 11 when viewed from the side facing the front surface of the apparatus.

The foreign material discharge chute 21 has one end connected to the inlet 2 and the other end connected to the outlet 3, as will be described below in detail. The foreign material discharge chute 21 causes a foreign material put into the inlet 2 to be discharged to the outlet 3 (see FIG. 9, for example).

Figure 6:
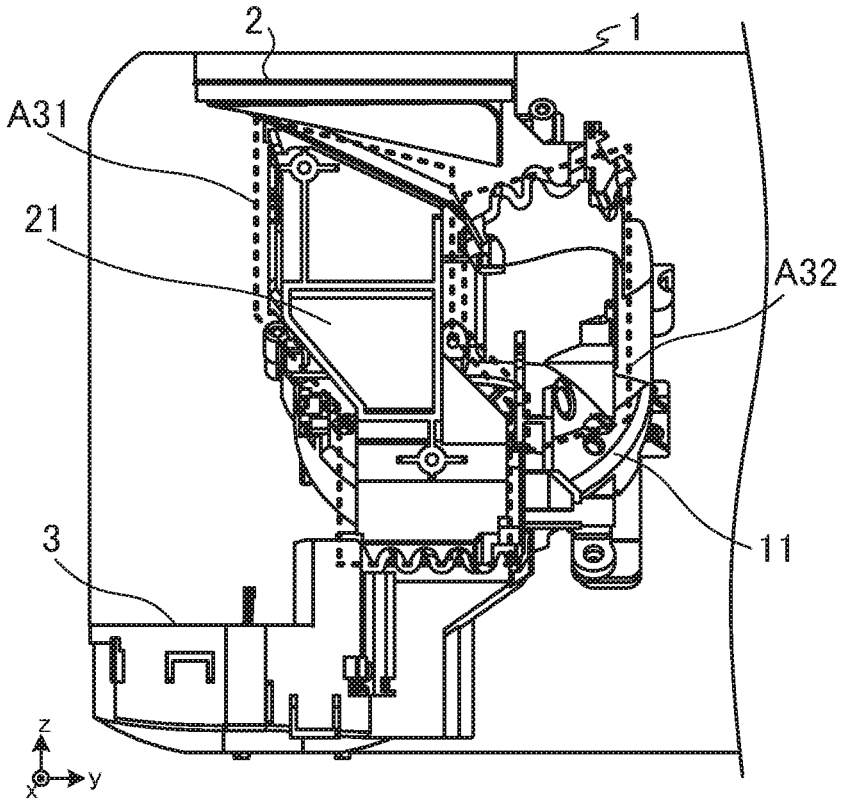
FIG. 6 is a side view of the coin handling apparatus in FIG. 5 viewed in a +x-axis direction.

FIG. 6 is a side view of the coin handling apparatus 1 in FIG. 5 viewed in the +x-axis direction. In FIG. 6, the same portions as those in FIG. 5 have the same reference characters.

In FIG. 6, the portion indicated by the dotted-line frame A31 is the foreign material discharge chute 21. One end of the foreign material discharge chute 21 is connected to the inlet 2, and the other end of the foreign material discharge chute 21 is connected to the outlet 3. The foreign material discharge chute 21 is so disposed as to overlap with the storing/feeding unit 11 in the y-axis direction.

Figure 7:
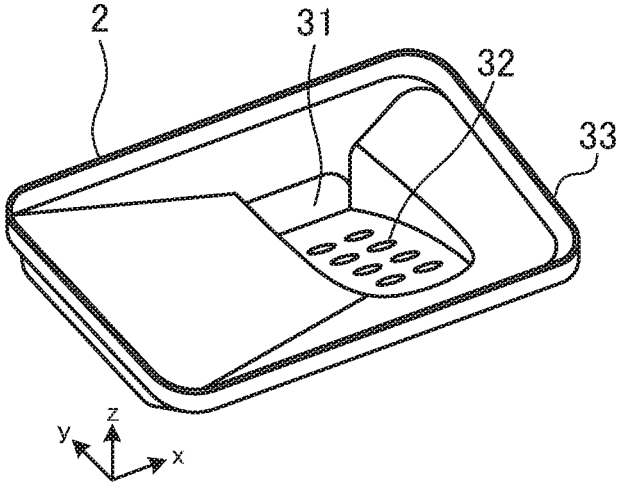
FIG. 7 is a perspective view of an inlet.

FIG. 7 is a perspective view of the inlet 2. The inlet 2 includes a coin entrance 31, foreign material discharge holes 32 and an edge 33, as shown in FIG. 7.

The inlet 2 is so shaped as to narrow from the edge 33, which has a roughly rectangular shape, toward the coin entrance 31, which is disposed below the inlet. In other words, the inlet 2 has an inclining surface present between the edge 33 and the coin entrance 31 and inclining obliquely downward toward the coin entrance 31. Coins put into the inlet 2 are therefore readily slide and drop to the coin entrance 31 with the aid of the weight of each coin. The coins put into the inlet 2 are therefore likely to be collected at the coin entrance 31.

The coin entrance 31 is an entrance via which the coins put into the inlet are taken into the apparatus. The coin entrance 31 leads to the hopper of the storing/feeding unit 11 via the chute (not shown). The coins put into the inlet 2 are therefore taken into the apparatus through the coin entrance 31, travel along the chute, and drop into the hopper of the storing/feeding unit 11.

The foreign material discharge holes 32 are provided on the upstream side of the coin entrance 31. In other words, the foreign material discharge holes 32 are disposed between the edge 33 and the coin entrance 31. The foreign material discharge holes 32 may also be formed in part of the inclining surface. The foreign material discharge holes 32 are so formed as not to allow the smallest coin handled by the coin handling apparatus 1 to pass through. For example, in a case where the foreign material discharge holes 32 have a circular shape, the diameter of the foreign material discharge holes 32 is smaller than the diameter of the smallest coin handled by the coin handling apparatus 1. The coins put into the inlet 2 therefore do not drop through the foreign material discharge holes 32 but pass the foreign material discharge holes 32 and enter the coin entrance 31. That is, the coins do not drop onto the foreign material discharge chute 21.

The foreign material discharge holes 32 do not necessarily have a circular shape. For example, the foreign material discharge holes 32 may have a rectangular shape. Also in the case where the holes have a rectangular shape or any other shape, the holes are so sized as not to allow the smallest coin to pass through.

The number of foreign material discharge holes 32 may be at least one. It is, however, noted that providing a plurality of foreign material discharge holes 32 instead of one can prevent a foreign material from entering the coin entrance 31 by a greater degree.

At least part of the foreign material discharge holes 32 may be formed in the inlet 2 in positions that do not overlap with the storing/feeding unit 11 in the plan view (when viewed in +z-axis direction). For example, at least part of the foreign material discharge holes 32 is so shifted rightward as not to overlap with the storing/feeding unit 11 when viewed from the side facing the front surface of the apparatus.

Further, at least part of the foreign material discharge holes 32 may be formed in the inlet 2 in positions that overlap with the storing/feeding unit 11 in the plan view. For example, at least part of the foreign material discharge holes 32 is so shifted rightward as to overlap with the storing/feeding unit 11 when viewed from the side facing the front surface of the apparatus.

Figure 8:
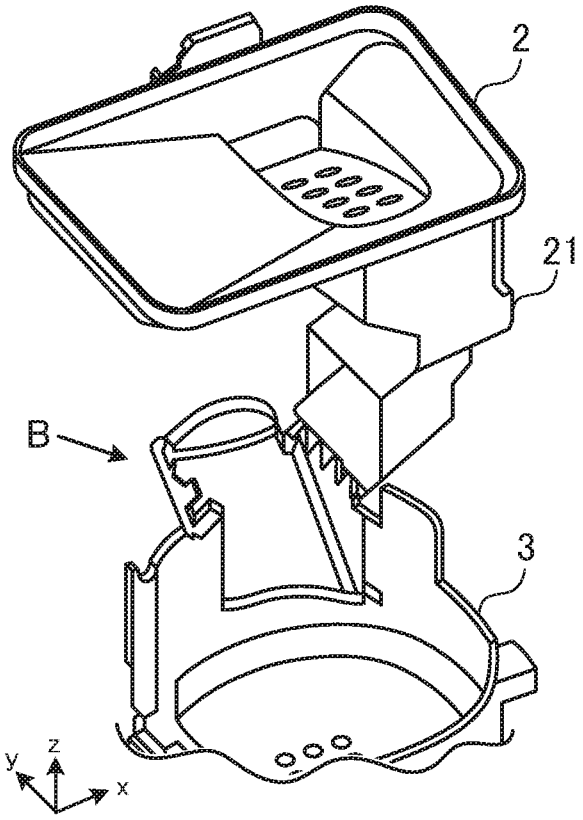
FIG. 8 is a perspective view of the inlet, a foreign material discharge chute, and an outlet.

FIG. 8 is a perspective view of the inlet 2, the foreign material discharge chute 21, and the outlet 3. In FIG. 8, the same portions as those in FIG. 5 have the same reference characters. In FIG. 8, the foreign material discharge chute 21 is fed in a simplified manner.

The foreign material discharge chute 21 has a curved shape and partially inclines, as shown in FIG. 8. For example, the foreign material discharge chute 21 is so curved as to protrude rightward when viewed from the side facing the front surface of the apparatus (in −y-axis direction). More specifically, the foreign material discharge chute 21 is first bent from the inlet 2 in the +x-axis direction and then folded back so that the foreign material discharge chute 21 is bent in the −x-axis direction. The foreign material discharge chute 21, however, does not need to be curved as a whole. For example, at least a sidewall of the foreign material discharge chute 21 or the sidewall facing the storing/feeding unit 11 only needs to be curved. Specifically, a sidewall of the foreign material discharge chute 21 or the sidewall facing the storing/feeding unit 11 may be first bent in the +x-axis direction at a point between the inlet 2 and the outlet 3 and then folded back so that the sidewall is bent in the −x-axis direction. The reason for this is that the curved structure prevents interference between the foreign material discharge chute 21 and the storing/feeding unit 11 (see FIG. 5, for example).

Figure 9:
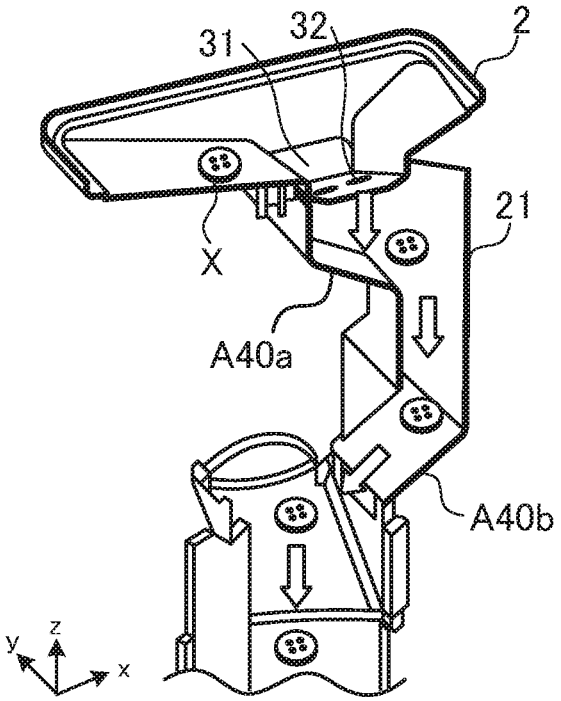
FIG. 9 shows how a foreign material drops along the foreign material discharge chute.

FIG. 9 shows how a foreign material drops along the foreign material discharge chute 21. In FIG. 9, the same portions as those in FIG. 8 have the same reference characters. FIG. 9 shows a foreign material X. The foreign material discharge chute 21 has an inclining surface A40*a*, which leads a foreign material in the +x-axis direction, and an inclining surface A40*b*, which leads the foreign material in the −x-axis direction. The thus shaped foreign material discharge chute 21 does not interfere with the storing/feeding unit 11. The foreign material X is assumed to have a size and a shape that allow the foreign material X to be discharged through any of the foreign material discharge holes 32 of the inlet 2.

The foreign material X accidentally put into the inlet 2 drops through any of the foreign material discharge holes 32. The foreign material discharge holes 32, which are provided on the upstream side of the coin entrance 31 as described above, can prevent the foreign material X from being taken into the apparatus.

The foreign material X having dropped through any of the foreign material discharge holes 32 travels along the foreign material discharge chute 21, as shown in FIG. 9, and drops to the outlet 3 (not shown in FIG. 9). The foreign material discharge chute 21, which partially inclines as indicated by the inclining surfaces A40*a* and A40*b*, can reduce the speed of the dropping foreign material X. A situation in which the foreign material X discharged to the outlet 3 jumps out of the outlet 3 due to an excessive speed of the foreign material X can therefore be avoided.

The storing/feeding unit 11 will now be described.

Figure 10:
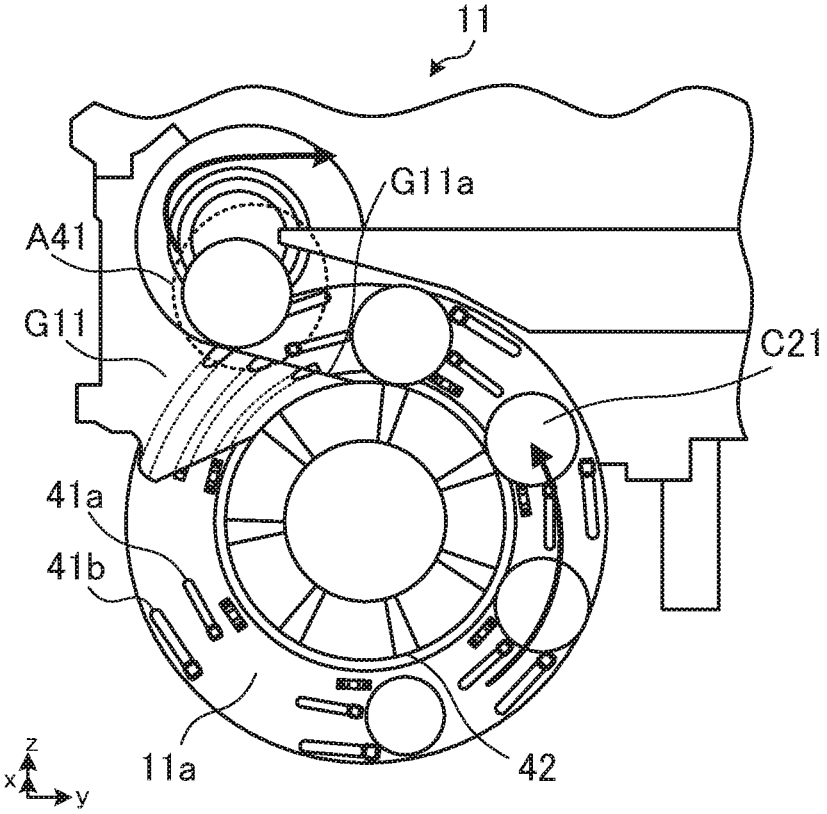
FIG. 10 shows an inclining disk of a storing/feeding unit viewed in +x-axis direction.

FIG. 10 shows the inclining disk 11*a* of the storing/feeding unit 11 viewed from the side facing the right-side surface of the apparatus (in +x-axis direction). FIG. 10 also shows a coin C21 picked up by the inclining disk 11*a*. FIG. 10 also shows a guide G11, which separates the coin C21 picked up by the inclining disk 11*a* from the inclining disk 11*a*.

The inclining disk 11*a* includes protruding members 41*a* and 41*b*, which pick up the coins stored in the hopper (not shown) one by one, and a coin circumferential edge holding unit 42, which holds (supports) the circumferential edge of each of the picked-up coins. The inclining disk 11*a* rotates counterclockwise in FIG. 10 when feeding the coins onto the transport unit 12.

The guide G11 is a plate-shaped member and is so disposed as to be slightly separate from the front surface of the inclining disk 11*a*. Grooves (indicated by dotted lines) along which the protruding members and other components on the inclining disk 11*a* travel are formed in a surface of the guide G11 or the surface facing the front surface of the inclining disk 11*a*.

The coin C21 picked up by the inclining disk 11*a* mounts on an upper end G11*a* of the guide G11. The coin C21 having mounted on the upper end G11*a* of the guide G11 moves along the upper end G11*a* of the guide G11, and the coin C21 is then separated from the inclining disk 11*a*. The coin C21 is then fed via a feeding exit indicated by the dotted-line frame A41 onto the transport unit 12.

Figure 11:
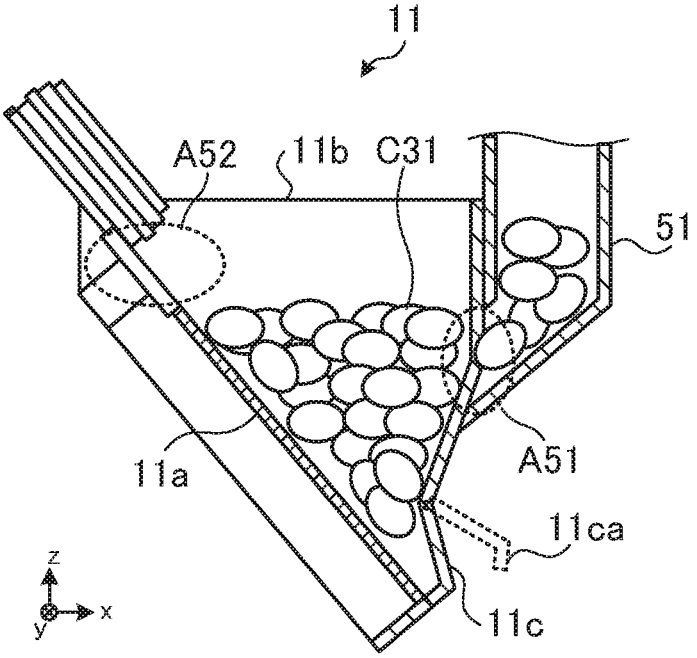
FIG. 11 shows an inclining disk of a storing/feeding unit viewed in −y-axis direction.

FIG. 11 shows the inclining disk 11*a* of the storing/feeding unit 11 viewed from the side facing the front surface of the apparatus (in −y-axis direction). In FIG. 11, the shapes of the inclining disk 11*a* and other components are fed in a simplified manner (protruding members on the front surface are omitted, for example).

The storing/feeding unit 11 includes a hopper 11*b*, as shown in FIG. 11. The hopper 11*b* is so provided as to cover (surround) the side facing the front surface of the inclining disk 11*a* and forms, along with the inclining disk, a space for accumulating coins C31.

A coin chute 51 is connected to the hopper 11*b*. For example, the coin chute 51 is connected to a surface of the hopper 11*b* or the surface facing the front surface of the inclining disk 11*a*.

An end of the coin chute 51 or the end that is not connected to the hopper 11*b* is connected to the coin entrance 31 of the inlet 2 shown in FIG. 7. A portion of the coin chute 51 or the portion connected to the hopper 11*b* is located below the coin entrance 31 of the inlet 2 (see the dotted-line frame A32 indicating the portion of the coin chute 51 in FIG. 6). Coins put into the inlet 2 therefore travel along the coin chute 51 with the aid of the weight of each coin and accumulate in the hopper 11*b*.

The position where the coin chute 51 is connected to the hopper 11*b* is located below the feeding exit of the storing/feeding unit 11. For example, the dotted-line frame A51 shown in FIG. 11 represents the position where the coin chute 51 is connected to the hopper 11*b*. The dotted-line frame A52 shown in FIG. 11 represents the feeding exit of the storing/feeding unit 11 (see dotted-line frame A41 in FIG. 10). The dotted-line frame A51 representing the position where the coin chute 51 is connected to the hopper 11*b* is below the dotted-line frame A52 representing the feeding exit of the storing/feeding unit 11.

A foreign material may drop through none of the foreign material discharge holes 32 but may be taken into the apparatus in some cases. For example, a foreign material having a size that does not allow the foreign material to pass through any of the foreign material discharge holes 32 does not drop through any of the foreign material discharge holes 32 and is taken into the apparatus. Foreign materials are therefore piled up in a lower portion of the hopper 11*b* in some cases.

To solve the problem described above, a discharge port 11*c*, through which the accumulated foreign materials are discharged, is formed in the lower portion of the hopper 11*b*. The discharge port 11*c* opens and closes, as indicated by the dotted line 11*ca* in FIG. 11. When the discharge port 11*c* opens as indicated by the dotted line 11*ca*, the foreign materials having accumulated in the lower portion of the hopper 11*b* are discharged from the hopper 11*b*.

The discharge port 11*c* is connected to the outlet 3 via a chute (not shown). The foreign materials discharged through the discharge port 11*c* are therefore discharged to the outlet 3. For example, the foreign materials are discharged to the outlet 3 in the direction indicated by the arrow B in FIG. 8.

Foreign materials that are discharged through the discharge port 11*c* and foreign materials that drop through the foreign material discharge holes 32 and are discharged along the foreign material discharge chute 21 are discharged to the outlet 3 in different directions. For example, foreign materials discharged through the discharge port 11*c* and foreign materials discharged along the foreign material discharge chute 21 are discharged in opposite directions.

Further, the outlet 3 may include a foreign material path, and foreign materials discharged through the discharge port 11*c* and foreign materials discharged along the foreign material discharge chute 21 may both be discharged into the foreign material path. The foreign material path at least partially inclines, and the foreign materials discharged into the foreign material path drop to a portion on the near (−y-direction) side of the outlet 3 with the aid of the weight of each foreign material. The foreign materials can therefore be readily taken out.

The foreign material path may instead be disposed in a far-side (+y-direction-side) end portion of the outlet 3.

The discharge port 11*c* opens and closes, for example, under the control of a controller (not shown). For example, when a sensor senses that a foreign material that had entered the hopper has not been fed but has kept remaining in the hopper, the controller opens the discharge port 11*c*.

The coin chute 51 is connected to the right side of the hopper 11*b*. The coin entrance 31 is therefore provided in a position shifted rightward when viewed from the side facing the front surface of the apparatus (see FIG. 5).

Figure 12:
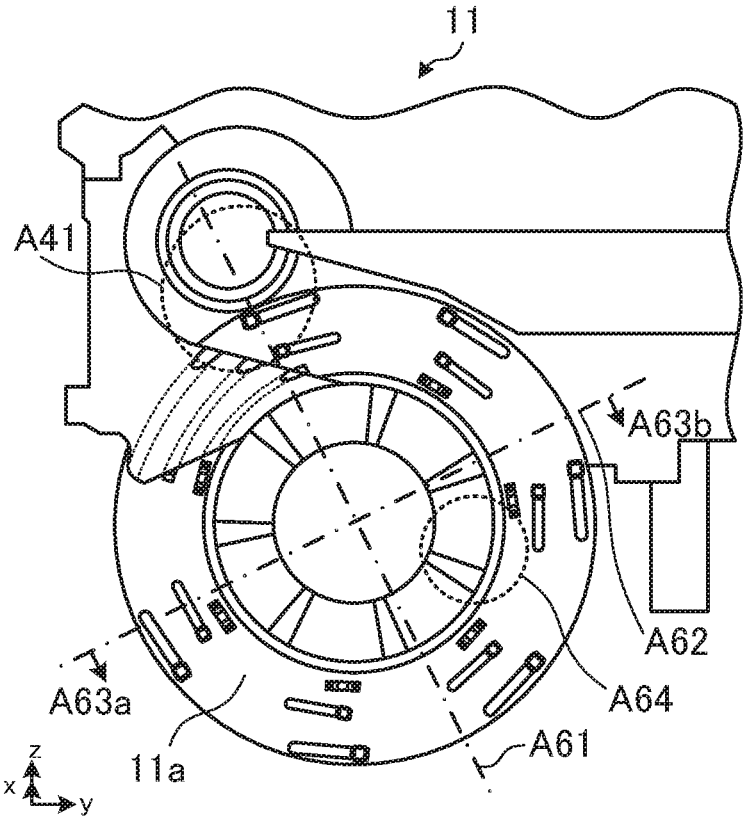
FIG. 12 describes the position where a coin chute is connected to a hopper.

FIG. 12 describes the position where the coin chute 51 is connected to the hopper 11*b*. In FIG. 12, the same portions as those in FIG. 10 have the same reference characters.

One end of the coin chute 51 is connected to a region of the hopper 11*b* or the region on one side of a straight line A62 shown in FIG. 12 or the side indicated by the arrows A63*a* and A63*b*. More specifically, the one end of the coin chute 51 is connected to a position on the hopper 11*b* or the position that belongs to one side of the inclining disk 11*a* divided by the straight line A62, which is perpendicular to a straight line A61, or the one side farther from the feeding exit. The straight line A61 is the straight line that connects the feeding exit represented by the dotted-line frame indicated by the arrow A41 to the center of the inclining disk 11*a*. The straight line A62 is a straight line parallel to the inclining disk 11*a*, perpendicular to the straight line A61, and passing through the center of the inclining disk 11*a*. That is, the one end of the coin chute 51 is so connected to the hopper 11*b* as to be separate downward from the feeding exit. If the one end of the coin chute 51 is connected to too low a position on the hopper 11*b*, however, the amount of accumulating coins decreases. It is therefore desirable to set the position where the one end of the coin chute 51 is connected to be close to the straight line A62.

The dotted-line frame A64 shown in FIG. 12 represents the portion where the chute 51 is connected to the hopper 11*b*. The dotted-line frame A64 belongs to the region on one side of the straight line A62 indicated by the arrows A63*a* and A63*b*.

A case where coins are dropped from a position above the hopper will be described.

Figure 13:
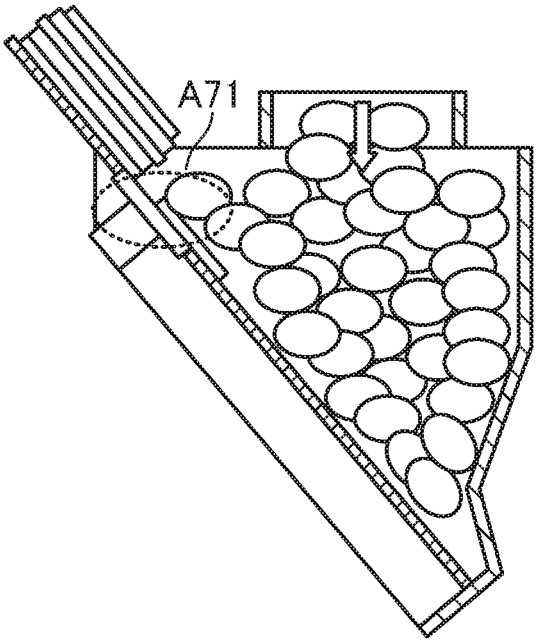
FIG. 13 describes a case where coins are dropped from a position above the hopper.

FIG. 13 describes the case where coins are dropped from a position above the hopper. When coins are dropped from a position above the hopper, the coins are piled up to the feeding exit indicated by the dotted-line frame A71, as shown in FIG. 13. In this case, the piled-up coins close the feeding exit, and the storing/feeding unit cannot appropriately feed the coins.

To avoid the situation described above, the storing/feeding unit 11 is so configured that the portion where the coin chute 51 is connected to the hopper 11*b* is located below the feeding exit of the storing/feeding unit 11, as described with reference to FIGS. 11 and 12. The coins are therefore not piled up to the feeding exit or do not close the feeding exit.

For example, the coins that accumulate in the hopper 11*b* do not accumulate beyond the portion where the coin chute 51 is connected to the hopper 11*b* (above the connection portion) and which is indicated by the dotted-line frame A51 in FIG. 11. Since the portion where the coin chute 51 is connected to the hopper 11*b* and which is indicated by the dotted-line frame A51 in FIG. 11 is located below the feeding exit indicated by the dotted-line frame A52 in FIG. 11, the coins are not piled up to the feeding exit.

As described above, the coin handling apparatus 1 includes the inlet 2, into which coins are put, the storing/feeding unit 11, which receives the coins put into the inlet 2, the outlet 3, to which coins are discharged, and the foreign material discharge chute 21, which is connected to the inlet 2 and the outlet 3 and along which a foreign material put into the inlet 2 is discharged to the outlet 3. The thus configured coin handling apparatus 1 can prevent a foreign material from entering the apparatus to reduce the occurrence of failure caused by the foreign material.

In the above description, the foreign material discharge chute 21 is curved. The foreign material discharge chute 21 may instead have a structure that causes a foreign material to drop vertically. For example, the foreign material discharge chute 21 may have a shape that does not incline but extends straight.

The foreign material discharge chute 21 may be provided with a sensor that senses passage of a foreign material. When the sensor senses passage of a foreign material, the sensor may notify a user of the passage of a foreign material.

The foreign material discharge chute 21 may be connected to a component other than the outlet 3. For example, the foreign material discharge chute 21 may be connected to a rejection port provided in the apparatus separately from the coin discharge unit.

The foreign material discharge chute 21 may be provided with a sensor that senses that a foreign material clogs or remains in the foreign material discharge chute.

The storing/feeding unit 11 is not limited to the storing/feeding unit described above. For example, the storing/feeding unit 11 may include a feeding disk that feeds coins received via the inlet 2, a classification/transport path that sorts and transports the coins fed by the feeding disk, and a transport member that transports the coins along the classification/transport path. The classification/transport path described above may be formed in a circular shape, and the feeding disk may be disposed inside the classification/transport path. The feeding disk may rotate around an axis extending in the vertical direction. The feeding disk feeds the received coins one by one. The classification/transport path is formed around the feeding disk. The classification/transport path may be a horizontal transport path flush with the feeding disk. The classification/transport path includes an identifier that evaluates the denomination and authenticity of a coin and a diverter for selection. The coins fed from the feeding disk are delivered to the classification/transport path, evaluated by the identifier in terms of denomination and authenticity, diverted from the classification/transport path by the diverter based on the result of the evaluation, and transported to a predetermined destination. A plurality of diverters are provided in accordance with the number of coin denominations.

In the above description, it is assumed that a foreign material is put along with coins, but, of course, not necessarily. For example, the foreign material described above includes a foreign material having somehow dropped into the inlet 2.

The foreign material discharge chute 21 may include a blocking member that blocks a dropping foreign material.

Figure 14:
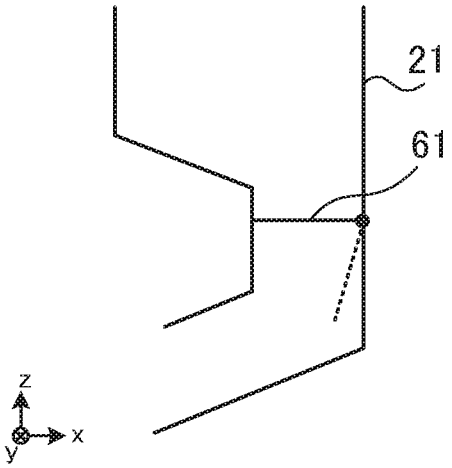
FIG. 14 describes a blocking member in the foreign material discharge chute.

FIG. 14 describes a blocking member in the foreign material discharge chute 21. FIG. 14 shows the foreign material discharge chute 21 and a blocking member 61. In FIG. 14, the shape and other factors of the foreign material discharge chute 21 are fed in a simplified manner.

The blocking member 61 is a plate-shaped member. The blocking member 61 is provided somewhere in the middle of the foreign material discharge chute 21 (between inlet 2 and outlet 3). The blocking member 61 is configured to open and close the passage hole (portion through which foreign material passes) of the foreign material discharge chute 21, as indicated by the dotted line in FIG. 14. When the blocking member 61 closes the passage hole of the foreign material discharge chute 21, a foreign material is blocked. On the other hand, when the blocking member 61 opens the passage hole of the foreign material discharge chute 21, as indicated by the dotted line, the blocked foreign material is discharged to the outlet 3. The blocking member 61 may be opened and closed by the controller or may be manually opened and closed.

(Additional Remark 1)

A coin handling apparatus including a deposit unit into which coins are put, a storing/feeding unit that includes a coin holding unit, an inclining disk, and a feeding exit, the coin holding unit temporarily accepting the coins put into the deposit unit in, and protrusions provided on a front surface of the inclining disk catching the accepted coins and feeding the caught coins to the feeding exit, and a coin chute along which the coins put into the deposit unit are dropped downward through the feeding exit into the coin holding unit.

(Additional Remark 2)

The coin handling apparatus described in Additional remark 1, wherein the coin chute has one end connected to the coin holding unit and the other end connected to the deposit unit in a position above the one end.

(Additional Remark 3)

The coin handling apparatus described in Additional remark 2, wherein the one end of the coin chute is connected to the coin holding unit that faces a region that belongs to one side of the inclining disk divided by a second straight line that is perpendicular to a first straight line that connects the feeding exit to the center of the inclining disk, is a straight line parallel to the inclining disk, and passes through the center of the inclining disk, the one side farther from the feeding exit.

(Additional Remark 4)

The coin handling apparatus described in Additional remark 3, wherein the coin chute partially inclines in such a way that the coins put into the deposit unit drop into the coin holding unit.

REFERENCE SIGNS LIST

1 Coin handling apparatus
2 Inlet
3 Outlet
11 Accumulating/feeding unit
11*a* Inclining disk
11*b* Hopper
11*c* Discharge port
12 Transport unit
13 Identifying unit
14, 15*a* to 15*d* Coin diverter
16*aa* to 16*ad*, 16*ba* to 16*bd* Storing/feeding unit
17 Withdrawal transport unit
18 Collection box
21 Foreign material discharge chute
31 Coin entrance
32 Foreign material discharge hole
41*a*, 41*b* Protruding member
42 Coin circumferential edge holding unit
51 Coin chute
61 Blocking member

The invention claimed is:

1. A coin handling apparatus, comprising:
a coin inlet unit into which coins are put;
a coin receiving unit that receives the coins put into the coin inlet unit;
a coin discharge unit to which the coins are discharged; and
a foreign material discharge chute which is connected to the coin inlet unit and the coin discharge unit and along which a foreign material is discharged to the coin discharge unit, the foreign material having been put into the coin inlet unit,
wherein the coin receiving unit includes a discharge port through which the foreign material having entered the coin receiving unit is discharged, and
the foreign material discharged through the discharge port of the coin receiving unit is discharged to the coin discharge unit.

2. The coin handling apparatus according to claim 1,
wherein the coin inlet unit includes one or more foreign material discharge holes each of which causes the foreign material to drop into the foreign material discharge chute.

3. The coin handling apparatus according to claim 1,
wherein the foreign material discharge chute is at least partly inclined.

4. The coin handling apparatus according to claim 3,
wherein the foreign material discharge chute has a curved shape.

5. The coin handling apparatus according to claim 3,
wherein the foreign material discharge chute has a shape at least a part of which is folded back.

6. The coin handling apparatus according to claim 3,
wherein at least one of the foreign material discharge holes is provided above the coin receiving unit so as to overlap with the coin receiving unit in a plan view, and
at least a part of the foreign material discharge chute has a shape that inclines along the coin receiving unit.

7. The coin handling apparatus according to claim 2,
wherein at least one of the foreign material discharge holes does not overlap with the coin receiving unit in a plan view.

8. The coin handling apparatus according to claim 2,
wherein the one or more foreign material discharge holes are formed so as not to allow a smallest coin handled by the apparatus to pass through.

9. The coin handling apparatus according to claim 2,
wherein the one or more foreign material discharge holes are formed on an upstream side of a coin inlet through which the coins are taken into the apparatus.

10. The coin handling apparatus according to claim 1,
wherein the foreign material discharge chute has a structure that causes the foreign material to vertically drop from the coin inlet unit to the coin discharge unit.

11. The coin handling apparatus according to claim 1,
wherein the coin receiving unit includes a feeding disk that feeds the coins received via the coin inlet unit, and
the feeding disk is an inclining disk that is rotatable about an axis that is inclined by a predetermined angle with respect to a horizontal direction.

12. The coin handling apparatus according to claim 1,
wherein the coin receiving unit includes:
a feeding disk that feeds the coins accepted via the coin inlet unit,
a classification transport path that sorts and transports the coins fed by the feeding disk, and
a transport member that transports the coins along the classification transport path.

13. The coin handling apparatus according to claim 12,
wherein the classification transport path is formed in a circular shape, and
the feeding disk is disposed inside the classification transport path.

14. The coin handling apparatus according to claim 1,
wherein the coin receiving unit includes an auxiliary chute along which the foreign material discharged through the discharge port is discharged to the coin discharge unit.

15. The coin handling apparatus according to claim 1,
wherein the foreign material discharge chute includes a blocking member that blocks the foreign material.

* * * * *